United States Patent [19]

McTigue et al.

[11] 4,266,173

[45] May 5, 1981

[54] ROLL COMPENSATED SEEKER HEAD

[75] Inventors: Larry D. McTigue; George T. Pinson, both of Huntsville, Ala.

[73] Assignee: The Boeing Company, Seattle, Wash.

[21] Appl. No.: 20,577

[22] Filed: Mar. 15, 1979

[51] Int. Cl.[3] ..... B64C 13/18

[52] U.S. Cl. ..... 318/585; 318/616; 318/648; 318/696

[58] Field of Search ..... 318/585, 648, 649, 616, 318/696; 343/7 A

[56] References Cited

U.S. PATENT DOCUMENTS

| | | | |
|---|---|---|---|
| 2,513,367 | 7/1950 | Scott | 318/640 X |
| 2,520,665 | 8/1950 | Warren | 318/585 X |
| 2,923,874 | 2/1960 | Bell | 318/585 |
| 3,099,005 | 7/1963 | Goldberg | 318/648 X |

*Primary Examiner*—B. Dobeck

*Attorney, Agent, or Firm*—Thomas H. Murray

[57] ABSTRACT

A digital, open-loop control system which compensates for the effects of roll on a missile-carried seeker head such as a radar antenna or an infrared sensor. The system utilizes a roll rate gyro affixed to the missile body for sensing the missile roll rate, developing a digital signal in proportion to the sensed roll rate, and using the digital signal in open-loop fashion to actuate a stepping servomotor for repositioning the seeker head so as to stabilize the same relative to the target irrespective of missile roll movements.

6 Claims, 6 Drawing Figures

Roll-stabilized Missile

Rolling Missile

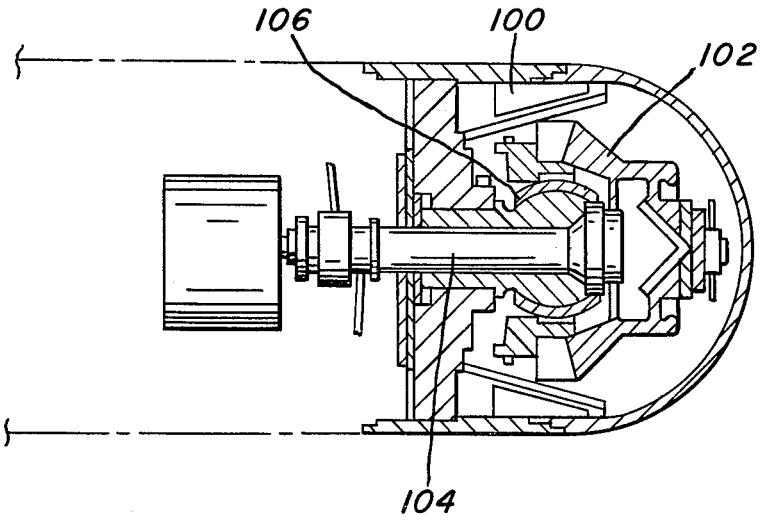
FIG. 4A.
FIG. 4B.
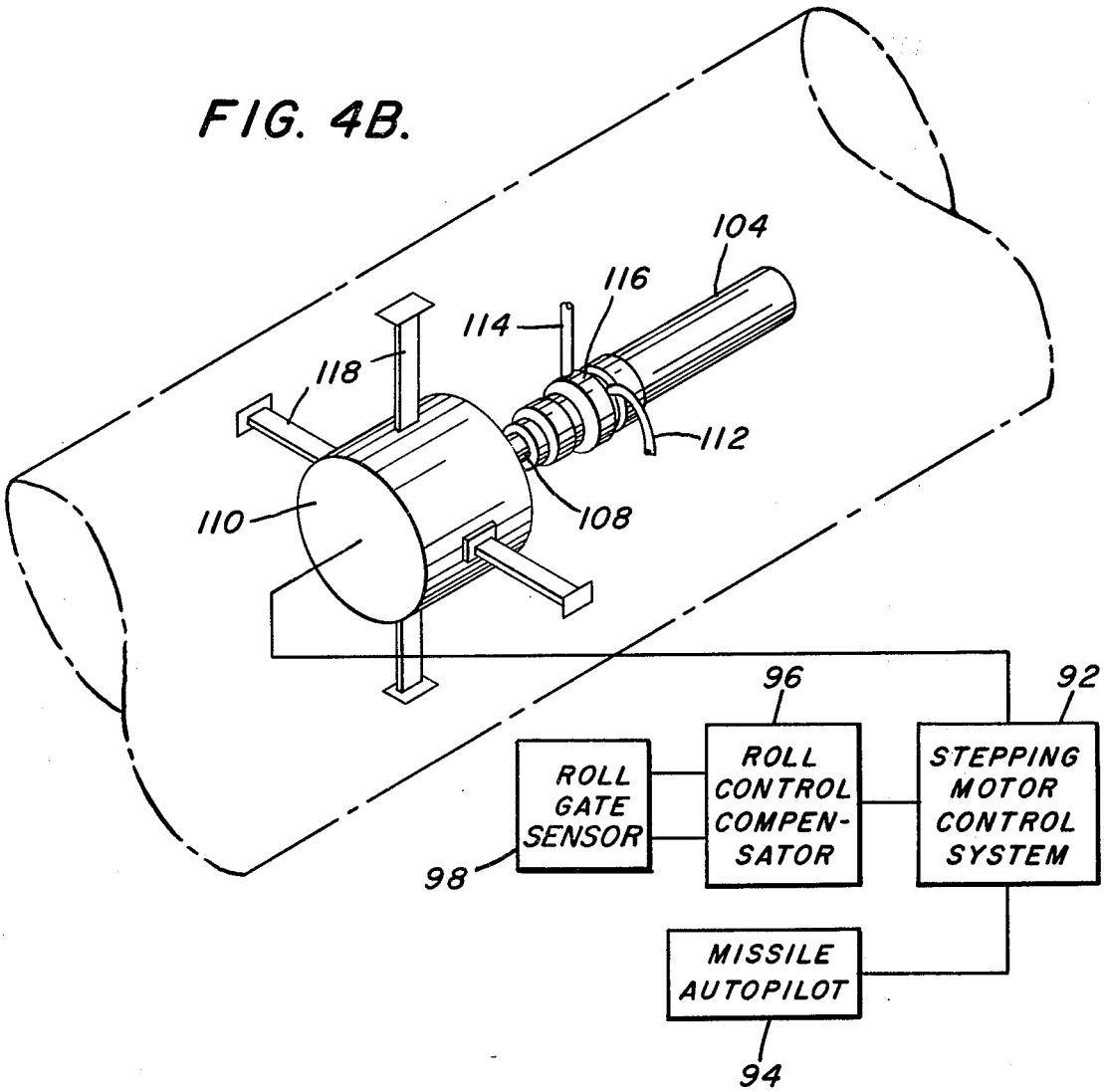

ROLL COMPENSATED SEEKER HEAD

BACKGROUND OF THE INVENTION

The present invention relates to apparatus for mounting on an aircraft, and particularly a missile, a sensor adapted to search an area in two dimensions for a target located at some unknown point. Most prior art mounts for sensors of this type are two degree of freedom devices which are unable to provide roll compensation as the missile or other aircraft rotates about its roll axis. As a result, and unless the missile is roll-stabilized about its longitudinal axis, image smearing will occur, meaning that the target will appear to move through an arc while, in fact, it is not. This smearing can result in the introduction of steering errors to the missile guidance system or the loss of signal if the signal strength is low and the missile is allowed to rotate at a high rate.

The usual technique for reducing image blurring to acceptable levels is to provide a roll control system for the missile. This, however, is an expensive solution requiring a gyro to detect roll motions, a closed-loop feedback control system to generate corrective commands, and an aerodynamic, reactive or propulsive control force mechanism to implement the corrective commands. Furthermore, a roll control system of this type still permits the missile to roll about its center line or longitudinal axis within tolerance limits. The acceptable angular roll rate is a function of the type of seeker and the information sampling rate at which the seeker is interrogated.

SUMMARY OF THE INVENTION

In accordance with the present invention, image smear problems of the type described above are eliminated or materially reduced by a digital stepping motor which rotates the sensor at a rate which compensates for roll of the missile as sensed by a roll gyro. Since the sensor (rather than the entire missile) is the only mass being rotated, a low-powered stepping motor can be used. The stepping motor control system is accomplished via an extremely simple, open-loop system. Each step command to the motor produces a very precise, predictable angular rotation. The control system has to compute and issue these commands at a rate that counters the missile roll rate. Apparatus for accomplishing this can be implemented in a low-cost microprocessor, or as an additional algorithm in the existing missile autopilot. The invention can be utilized to provide roll compensation to conventional rotating mass seeker heads, torqued gyro heads, gimbaled heads or to the digital non-gimbaled seeker head described in copending application Ser. No. 891,982, filed Mar. 31, 1978.

Specifically, and in accordance with the invention, there is provided, in an aircraft such as a missile subject to rolling motions about its longitudinal axis, the combination of apparatus for mounting on said aircraft a sensor adapted to search an area in two dimensions for a target located at some unknown point. Means are provided for sensing rolling movements of the aircraft about its longitudinal axis, and means are coupled to the sensing means for rotating the mounting apparatus about said longitudinal axis in amounts substantially equal and opposite to the rolling movement sensed by the sensing means, the amount of movement of the mounting means by the rotating means being as great as 360° or more. As was mentioned above, the means for rotating the mounting means is preferably a digital stepping motor which will advance the mounting means about the longitudinal axis of the aircraft in discrete, incremental amounts as the aircraft rolls about its longitudinal axis.

The above and other objects and features of the invention will become apparent from the following detailed description taken in connection with the accompanying drawings which form a part of this specification, and in which:

FIGS. 4A and 4B illustrate another embodiment of the invention as applied to a conventional spinning mass seeker.

Figure 1A:
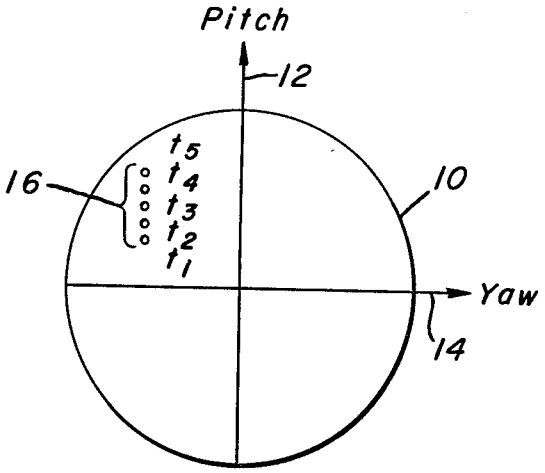
FIGS. 1A and 1B illustrate the image blurring or smearing caused by a rolling aircraft incorporating a conventional seeker head which does not employ the principles of the invention.
Figure 1B:
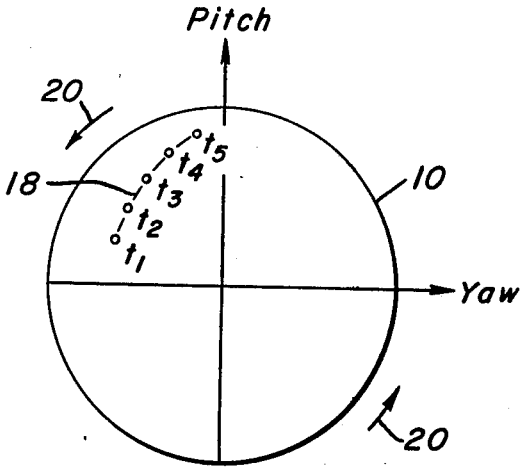

With reference now to the drawings, and particularly to FIGS. 1A and 1B, the field of view of a radar antenna or the surface of an infrared detector, for example, is indicated by the circle 10. The field of view is divided into four quadrants by a pitch axis 12 and a yaw axis 14. Normally, the mounting system is such that a sensor can move in two dimensions along either the pitch axis 12 or the yaw axis 14 to locate a target anywhere within the field of view defined by the circle 10. Assuming that the aircraft on which the sensor is mounted is not rotating about its longitudinal axis, which is at right angles to the axes 12 and 14, the trace of a target image at times $t_1$ through $t_5$ is indicated by the circles 16. The target, it will be noted, is moving upwardly in the fourth quadrant along an essentially straight line. If, however, the aircraft (e.g., missile) is rolling about its roll axis, the target image will no longer move through a straight line, as it should to indicate a straight-line movement of the target, but will rather move along an arc or curvature 18 as shown in FIG. 1B. This, of course, gives false information as regards the location of the target with respect to the aircraft and can result in loss of signal if the signal strength is low and the aircraft is rolling at a relatively high rate. In the illustration given in FIG. 1B, the aircraft would be rolling or rotating in the direction of arrows 20.

Figure 2:
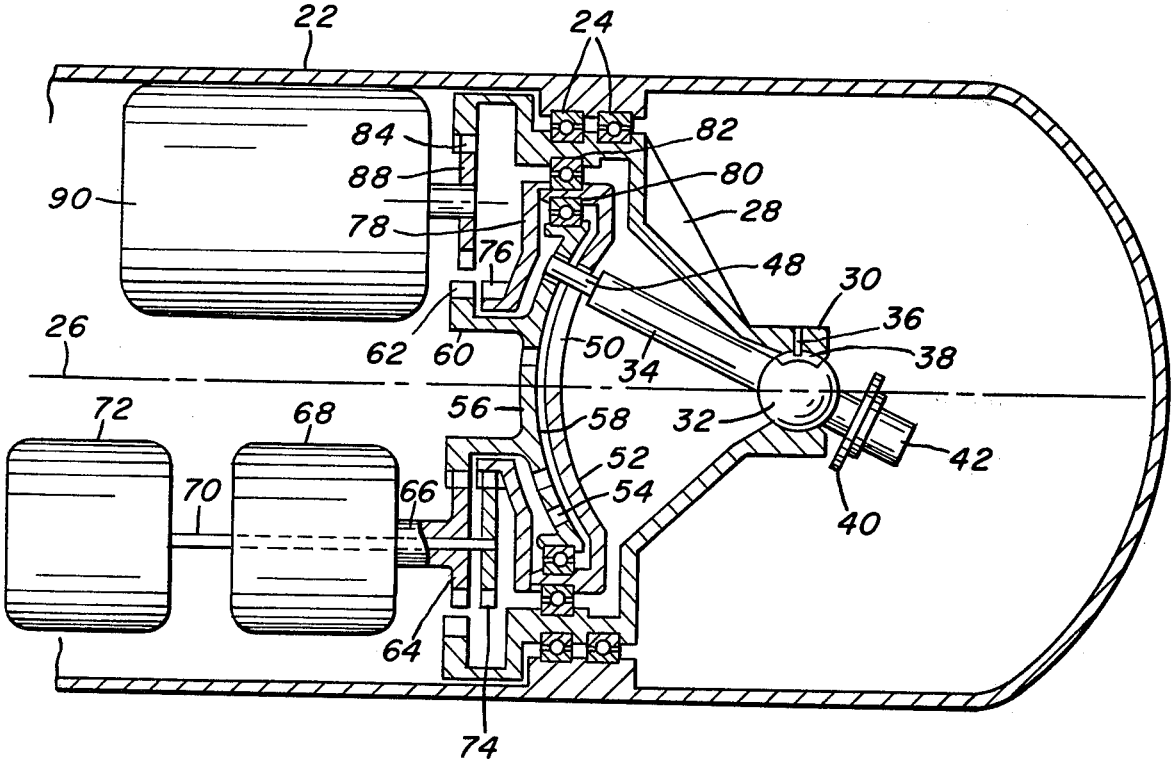
FIG. 2 is a cross-sectional view of one embodiment of the invention employing a non-gimbaled seeker head.
Figure 3:
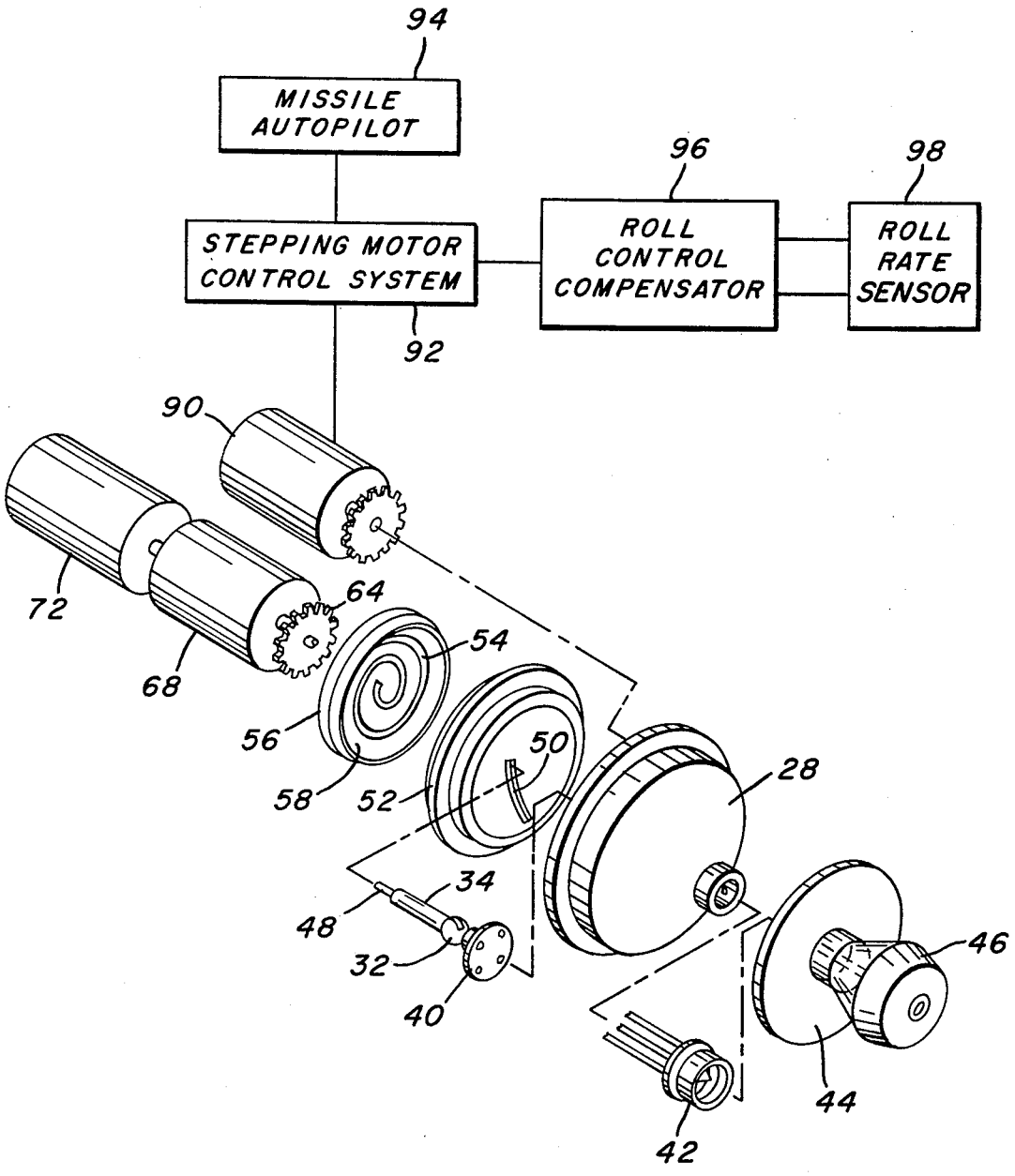
FIG. 3 is an exploded view of the embodiment of the invention shown in FIG. 2.

One embodiment of the invention adapted to compensate for the rolling motion illustrated in FIG. 1B is shown in FIGS. 2 and 3. In this particular embodiment of the invention, the seeker is mounted on a non-gimbaled platform assembly. In FIG. 2, the outer skin of a missile, for example, is designated by the reference numeral 22. Encircling the inner periphery of the missile are spaced, annular ball bearings 24 which support, for rotation about the longitudinal axis 26 of the missile, a spider assembly 28, perhaps best shown in FIG. 3. Centrally disposed on the spider assembly 28 is a socket 30 which receives a ball 32 forming part of a shaft 34, the arrangement being such that the forward end of the shaft 34 can be simultaneously moved in azimuth and elevation. A pin 36 projecting from the inner surface of socket 30 fits into an arcuate slot 38 formed in the ball 32. Slot 38 extends parallel to the axis of the shaft 34, the combination of the pin 36 and slot 38 acting to prevent rotation of the shaft 34 about its own longitudinal axis. The forward end of the shaft 34 carries a mounting plate 40 which, in the embodiment of the invention shown in FIGS. 2 and 3, carries a detector or sensor 42, such as an infrared detector. Ahead of the detector 42, as shown in FIG. 3, are reflectors 44 and 46 which direct energy sensed in the four quadrants shown in FIGS. 1A and 1B onto the face of detector 42. It will be understood, of course, that instead of using an infrared detector, a radar antenna or other type of sensor can be used equally well.

The end 48 of shaft 34 opposite the ball 32 passes through a radial slot 50 formed in a first rotatable plate 52 and into a spiral groove or slot 54 formed in a second rotatable plate 56, the details of the groove 54 being best shown in FIG. 3. It will be noted that the groove 54 is formed in a forward, concave face 58 of the rotatable plate 56. The plate 56, as best shown in FIG. 2, is provided with a rearwardly-extending annular projection 60 which carries gear teeth 62 on its periphery. The gear teeth 62, in turn, mesh with a gear 64 connected through a hollow shaft 66 to a first stepping drive motor 68. Extending through the hollow shaft 66 is the drive shaft 70 of a second stepping drive motor 72. Carried at the forward end of the shaft 70 for motor 72 is a gear 74 which meshes with annular gear teeth 76 carried on the inner peripheral portion of a disc-shaped member 78 connected at its outer periphery to the first rotatable plate 52 having the radial slot 54 formed therein.

The rotatable plate 52 is mounted for rotation on plate 56 by ball bearing 80. The plate 52, in turn, is mounted for rotation on the spider assembly 28 by means of ball bearing 82. It can be readily appreciated, therefore, that the spider assembly 28, the plate 52 and the plate 56 can all rotate independently about the longitudinal axis 26.

If it is assumed that the plate 52 is stationary while the plate 56 incorporating the groove 54 rotates, the line of sight of the detector 42 will move along a linear path, as guided by the slot 50, as the shaft 34 moves radially inwardly or outwardly upon rotation of the plate 56 in one direction or the other. On the other hand, if the forward plate 52 rotates while the plate 56 carrying the slotted groove 54 remains stationary, the line of sight of the detector 42 will scan a spiral pattern. Finally, if both plates 52 and 56 rotate in the same direction at the same speed, the line of sight of the detector 42 will perform a conical scan at an angle determined by the radial distance of the reduced diameter end 48 from the longitudinal axis 26. Furthermore, it will be appreciated that by appropriate rotation of the two plates 52 and 56 by the stepping motors 68 and 72, the line of sight of the detector 42 can be moved to any point in a two-dimensional field of view, such as the field of view 10 shown in FIGS. 1A and 1B.

As described in copending application Ser. No. 891,982, the two stepping motors 68 and 72 are connected to motor controller circuits which are, in turn, connected to a search pattern generator, the arrangement being such that the detector 42 will perform a conical, spiral or linear searching pattern as determined by the search pattern generator.

As thus far described, the detector 42 can search the field of view 10 shown in FIGS. 1A and 1B in two dimensions only. In order to compensate for rolling motions of the missile about its longitudinal axis 26, the spider assembly 28 is provided with gear teeth 84 (FIG. 2) which mesh with pinion gear 88 connected to a third digital stepping motor 90. As shown in FIG. 3, the stepping motor 90 is connected to a stepping motor control system 92 which is connected to the missile autopilot 94 as well as a roll control compensator 96 connected to a roll rate gyro 98, or other sensor, mounted on the missile. The sensor 98 senses the missile roll rate and sends this signal to the roll control compensator. The compensator 96 consists of a control system which generates the rate of rotation required to compensate for missile roll. This rate of rotation, in the form of an electrical signal, is applied to the stepping motor control system 92 which, in turn, issues discrete commands to the digital stepping motor 90 to rotate in the appropriate direction and thereby rotate spider assembly 28 in the appropriate direction to compensate for missile roll. Note that by virtue of pin 36 which extends into slot 38 in the ball 32, the entire assembly including detector 42, shaft 34 and the plates 52 and 56 must rotate as the spider assembly 28 rotates. The commands sent by the digital stepping motor control system 92 of FIG. 3 are also sent to the missile autopilot 94 so that knowledge is always retained by the autopilot of the orientation of the detector relative to a fixed body coordinate system. It will be noted that the entire scanning assembly can be rotated through 360° or through a number of complete revolutions by the stepping motor 90, if necessary. Thus, if the missile should roll about its longitudinal axis in the direction of arrows 20 shown in FIG. 1B, for example, the spider assembly 28 and the parts which it carries will be rotated in the opposite direction in an equal amount such that the detector 42 will sense a target moving along a straight line as viewed in FIG. 1A rather than the curved path 18 of FIG. 1B which results in target blurring or smearing as explained above.

FIGS. 4A and 4B illustrate another embodiment of the invention as applied to a conventional spinning mass seeker. The field windings 100 of the seeker are fixed to the airframe; while the rotating optics 102 are separated from the sensor or detector 104 by an air bearing 106. The detector 104 is mounted at the end of an armature 108 (FIG. 4B) of a digital stepping motor 110 connected to control circuitry identical to that described in connection with FIG. 3. Elements of the control circuitry corresponding to those of FIG. 3 are identified by like reference numerals. Electrical power and signals from the detector 104 are taken from a wire bundle 112. A gas supply fed through conduit 114 provides detector coolant gas to the detector 104 through a rotary gas joint 116. In this case, it will be noted that the stepping motor 110 is supported on the airframe, not shown, by means of supports 118. As in the previous embodiment of the invention, the roll rate sensor 98 senses the missile roll rate and sends this signal to the roll control compensator 96. The stepping motor control system issues discrete commands to the digital stepping motor 110 to rotate it in the appropriate direction to compensate for missile roll, these same commands from the stepping motor control system 92 being applied to the missile autopilot 94. With the wire bundle connection 112 shown in FIG. 4B, the detector 104 ordinarily cannot be rotated through more than about 360°; however by providing slip rings or an optical data link connecting the detector to appropriate transmitting and receiving circuitry, any degree of rotation can be effected.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. In an aircraft subject to rolling motions about its longitudinal axis, the combination of apparatus for mounting on said aircraft a sensor adapted to search an area in two dimensions for a target located at some unknown point, a roll rate gyro for sensing rolling movements of said aircraft about said longitudinal axis, and means including a roll control compensator coupled to said roll rate gyro for rotating said mounting apparatus about said longitudinal axis in an amount substantially equal and opposite to the rolling movement sensed by said roll rate gyro, the amount of movement of said mounting means by said rotating means being as great as 360°.

2. The combination of claim 1 wherein the means for rotating said mounting apparatus includes a digital stepping motor, and a stepping motor control system coupled to said roll control compensator and to said digital stepping motor for causing the motor to rotate said mounting apparatus in an appropriate direction to compensate for missile roll.

3. The combination of claim 2 including an autopilot for said missile, and means coupling said stepping motor control system to said autopilot.

4. The combination of claim 2 including a mounting plate for said sensor, a shaft secured at one end to said mounting plate, means mounting said shaft intermediate its ends for simultaneous movement in two directions whereby the axis of said shaft can be made to intersect any point in a field of view, a rotatable plate having a face formed with a generally spiral groove which receives the end of said shaft opposite said mounting plate, a member between said plate and mounting means and carried for rotation about an axis extending through the central axis of said spiral groove, a slot in said member extending radially outwardly from the axis of rotation of the member and into which said shaft extends, and separate means for independently rotating said plate and said slotted member.

5. The combination of claim 4 wherein said separate means for independently rotating said plate and said slotted member comprises second and third stepping motors.

6. The combination of claim 4 wherein said means for mounting said shaft, said rotatable plate and said rotatable member are carried on a rotatable spider assembly, and means coupling said rotatable spider assembly to said first-mentioned stepping motor.

* * * * *